US009629515B2

(12) United States Patent
Chan et al.

(10) Patent No.: US 9,629,515 B2
(45) Date of Patent: Apr. 25, 2017

(54) MULTI-SIDED, ROTABLE TINES FOR A DISHWASHER RACK

(71) Applicants: BSH Home Appliances Corporation, Irvine, CA (US); BSH Hausgeräte GmbH, Munich (DE)

(72) Inventors: Kasin Chan, Corona, CA (US); Myk Lum, Irvine, CA (US); David Chavez, San Francisco, CA (US)

(73) Assignees: BSH Home Appliances Corporation, Irvine, CA (US); BSH Hausgeräte GmbH, Munich (DE)

( * ) Notice: Subject to any disclaimer, the term of this patent is extended or adjusted under 35 U.S.C. 154(b) by 32 days.

(21) Appl. No.: 14/813,153

(22) Filed: Jul. 30, 2015

(65) Prior Publication Data

US 2017/0027412 A1 Feb. 2, 2017

(51) Int. Cl.
*A47B 77/08* (2006.01)
*A47L 15/50* (2006.01)

(52) U.S. Cl.
CPC ..... *A47L 15/503* (2013.01)

(58) Field of Classification Search
CPC .... A47L 15/503; A47L 15/505; A47L 15/501; A47L 15/50
USPC ..... 211/41.8, 41.9, 210; 312/228.1
See application file for complete search history.

(56) References Cited

U.S. PATENT DOCUMENTS

| | | | | |
|---|---|---|---|---|
| 5,205,419 | A * | 4/1993 | Purtilo | A47L 15/505 134/200 |
| 5,601,195 | A * | 2/1997 | Finola | A47L 15/503 211/41.8 |
| 7,231,929 | B2 | 6/2007 | Landsiedel et al. | |
| 8,408,403 | B2 * | 4/2013 | Hedstrom | A47L 15/503 211/181.1 |
| 2005/0242046 | A1 | 11/2005 | Lee | |
| 2009/0120883 | A1 * | 5/2009 | Jadhav | A47L 15/505 211/41.9 |
| 2014/0174486 | A1 * | 6/2014 | Fey | A47L 15/503 134/135 |
| 2015/0053238 | A1 * | 2/2015 | Lee | A47L 15/4409 134/18 |
| 2015/0335225 | A1 * | 11/2015 | Seu | A47L 15/502 211/41.9 |

FOREIGN PATENT DOCUMENTS

| | | | |
|---|---|---|---|
| EP | 1859722 | A1 | 11/2007 |
| EP | 2272416 | A2 | 1/2011 |
| WO | 2013045543 | A1 | 4/2013 |

* cited by examiner

*Primary Examiner* — Matthew Ing
(74) *Attorney, Agent, or Firm* — Michael E. Tschupp; Andre Pallapies

(57) ABSTRACT

A domestic appliance, and a dishwasher in particular, which includes a rack which is able to be reversibly pulled out from within the dishwasher for the placement of dishware and/or crockery, wherein the rack includes an actuator configured to rotate a multi-sided rotatable tine body such as to select between a discrete number of predetermined tine configurations which differ in tine height, spacing, and the distance between tines.

17 Claims, 9 Drawing Sheets

MULTI-SIDED, ROTABLE TINES FOR A DISHWASHER RACK

FIELD OF THE TECHNOLOGY

The present technology relates to a domestic dishwasher. More specifically, the present technology relates to an improved dishwasher featuring a rack configured to provide improved functionality, efficiency, and/or robustness.

BACKGROUND

A common domestic appliance found in many homes is the dishwasher. The dishwasher generally includes a compartment within which dishes and/or crockery are placed for treatment and/or washing. The compartment usually contains at least one rack designed to hold the items placed within the compartment for cleaning. The compartment is generally enclosed and sealed by a hinged door or sliding drawer, either of which may have a handle. Within the compartment, there are usually a number of sprayers, e.g., nozzles, arranged to provide spraying water to assist with the treatment and/or washing of dishes and/or crockery. A basin designed to collect water sprayed from the nozzles is located within the base of the compartment. The basin contains a drain and a hose which allows water to drain and be removed from the compartment at the conclusion of a wash cycle. The dishwasher also includes a detergent and/or prewash dispenser arranged and configured to release detergent and/or prewash into the compartment during the wash and/or treatment cycle. The dispenser often includes a cover to hold the detergent and/or prewash in place and may be arranged to selectively release the detergent into the compartment.

The rack may include wheels and/or rollers to allow the rack to roll out from within the compartment and grant access to the whole of the rack to a user wanting to place dishes and/or crockery into or remove dishes and/or crockery from within the dishwasher. The racks may be configured to have a particular permanent design to accommodate a variety of shapes which may be placed into the rack as dishware and/or crockery. The design may feature tines or prongs which project from the rack as part of a particular permanent design such that dishware and/or crockery can be organized when placed into the rack.

Designing a rack with a particular permanent shape and design has limitations and shortcomings. In particular, dishware, crockery, glassware, and utensils are increasingly and continuously being designed in a variety of shapes and sizes. Therefore, a rack with a singular configuration with a permanent shape, including having projecting tines, may not be able to accommodate a sufficient amount of differing items in a particular wash cycle due to differences in size and shape. This limitation requires a user to run multiple dishwasher cycles, whereby each cycle of the dishwasher is run at less than its most efficient state due to inefficient or incomplete loading of the dishwasher via its rack or racks. Additionally, some shapes or arrangements of racks within a dishwasher may prevent some items, due to their shape, size, or height, from being able to be loaded and/or washed within the dishwasher at all.

A need has developed to address one or more shortcomings of the prior art.

BRIEF SUMMARY

The present technology addresses one or more of the shortcomings of the prior art.

An aspect of the present technology includes a dishwasher with at least one rack with an adjustable shape and/or configuration to accommodate a variety of items to be placed in the dishwasher.

Another aspect of the present technology includes a dishwasher with at least one rack with adjustable tines configured to allow multiple tine size and/or spacing arrangements within the rack.

Another aspect of the present technology includes a dishwasher with a third rack comprising at least one set of adjustable tines configured to accommodate a variety of items within the third rack.

Another aspect of the present technology includes a dishwasher with a third rack arranged as a top rack comprising at least one set of adjustable tines configured to allow multiple arrangements of tine height and/or tine spacing.

Another aspect of the present technology includes a domestic appliance comprising: a housing; a compartment within the housing; an opening arranged in the compartment configured to allow the insertion and/or removal of items to be cleaned and/or treated into the housing; a door configured to close the opening and create a sealed compartment during use; and a first component arranged within the compartment configured to receive items to be washed and/or treated during use of the domestic appliance; wherein the first component is configured to have an arrangement that is able to be changed by a user of the domestic appliance when the appliance is not in use to alter the items which can be received within the first component.

Another aspect of the present technology includes a dishwasher comprising: a housing; a compartment within the housing; an opening arranged in the compartment configured to allow the insertion and/or removal of dishware and/or crockery to be cleaned and/or treated into the housing; a door configured to close the opening and create a sealed compartment during use; and at least a rack, the rack being a third, top rack slidably installed within the compartment and configured to be movable from a retracted position where the rack is substantially within the compartment to an extended position where the rack is substantially projecting out of the compartment; wherein the rack is configured to have an adjustable shape and/or configuration to accommodate a variety of different sized and shaped items of dishware, utensils, and/or crockery.

Other aspects, features, and advantages of this technology will become apparent from the following detailed description when taken in conjunction with the accompanying drawings, which are a part of this disclosure and which illustrate, by way of example, principles of this technology.

BRIEF DESCRIPTION OF THE DRAWINGS

FIG. 3(*b*) is an illustrative example of a standard top rack provided in a standard dishwasher comprising three racks.

FIG. 4(*b*) is a perspective view of a rack according to a first example of the present technology in a second configuration.

FIG. 4(*c*) is a perspective view of a rack according to a first example of the present technology in a third configuration.

FIG. 5(*b*) is an additional perspective view of a rack according to a second example of the present technology.

DETAILED DESCRIPTION

The following description is provided in relation to several examples which may share common characteristics and features. It is to be understood that one or more features of any one example may be combinable with one or more features of the other examples. In addition, any single feature or combination of features in any of the examples may constitute additional examples.

Throughout this disclosure, terms such as first, second, third, etc., are used. However, use of such terms are not intended to be limiting or indicative of a specific order or preference, but instead are used to distinguish similarly described features from one another.

Figure 1:
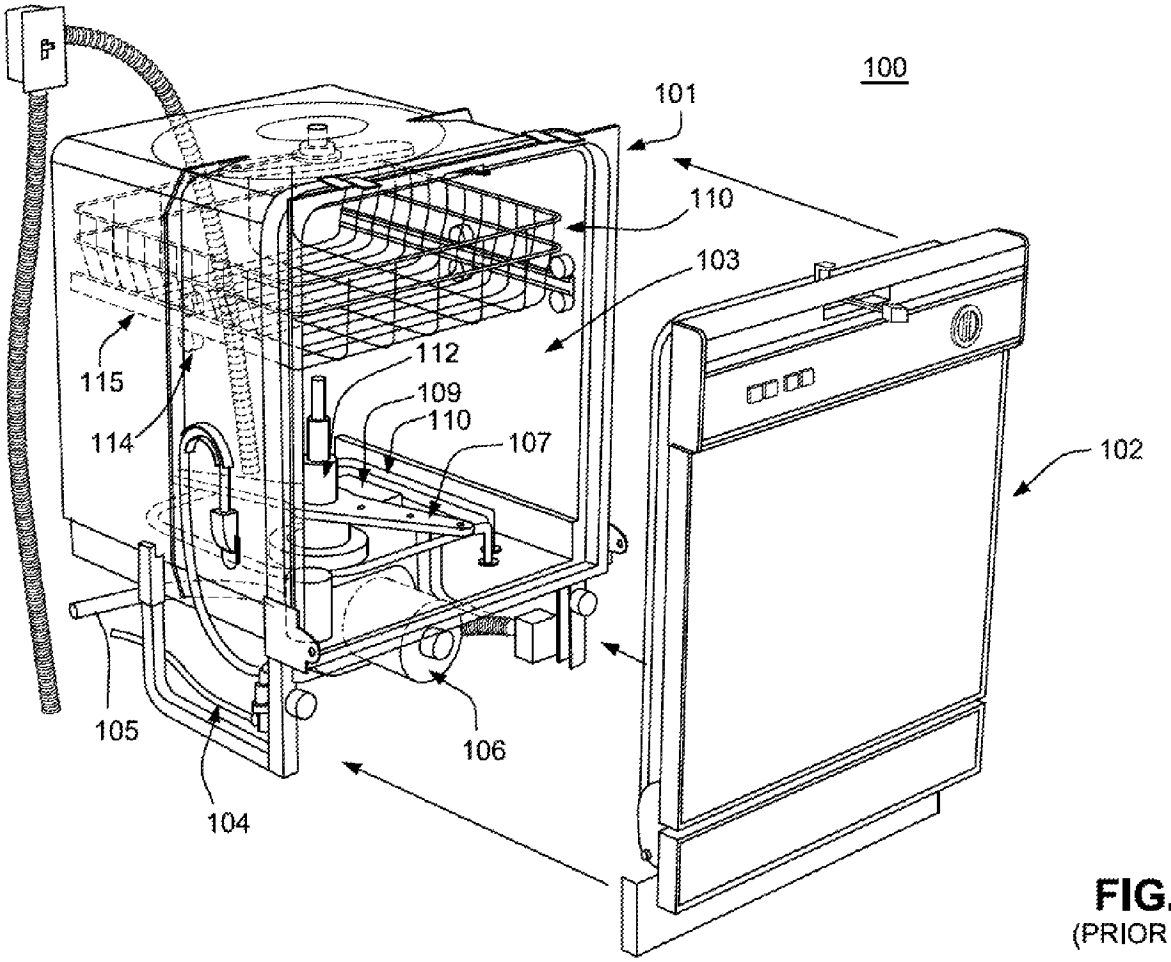
FIG. 1 (PRIOR ART)
FIG. 1 is an illustrative example of a standard dishwasher.

FIG. 1 shows an illustrative example of a standard dishwasher 100. The dishwasher as depicted is illustrated with its door 102 unattached to the dishwasher housing 101 and thus illustrates an open compartment 103 within the housing 101. The dishwasher 100 includes a water supply line 104 and a drain line 105. The dishwasher also includes at least one motor 106 which is utilized to rotate at least a first spraying element 107. Additional motors may be provided to rotate additional spraying elements which may be attached to, i.e., rack 110, the top of the compartment, and other locations determined to beneficially provide spraying to the interior of the dishwasher. Water is supplied to the dishwasher via water supply line 104 from an external source and pumped to the spraying elements via pump 109. Water may also be supplied and/or pumped to nozzles and/or spouts provided in addition to the spraying elements discussed above, such as on the walls or roof of the compartment, or via passageways which may be static or dynamic as well as fashioned within other components like a central spraying element 112, which may be configured to be extendable during a wash cycle. Water supplied to the system and/or the interior of the compartment may be heated by heating element 111. The rack may be installed within the compartment along sliding rails 115 with wheels 114 to facilitate movement into and out of the compartment. Although a door is used throughout this description, any suitable closure, such as a drawer, may also be used.

Figure 2:
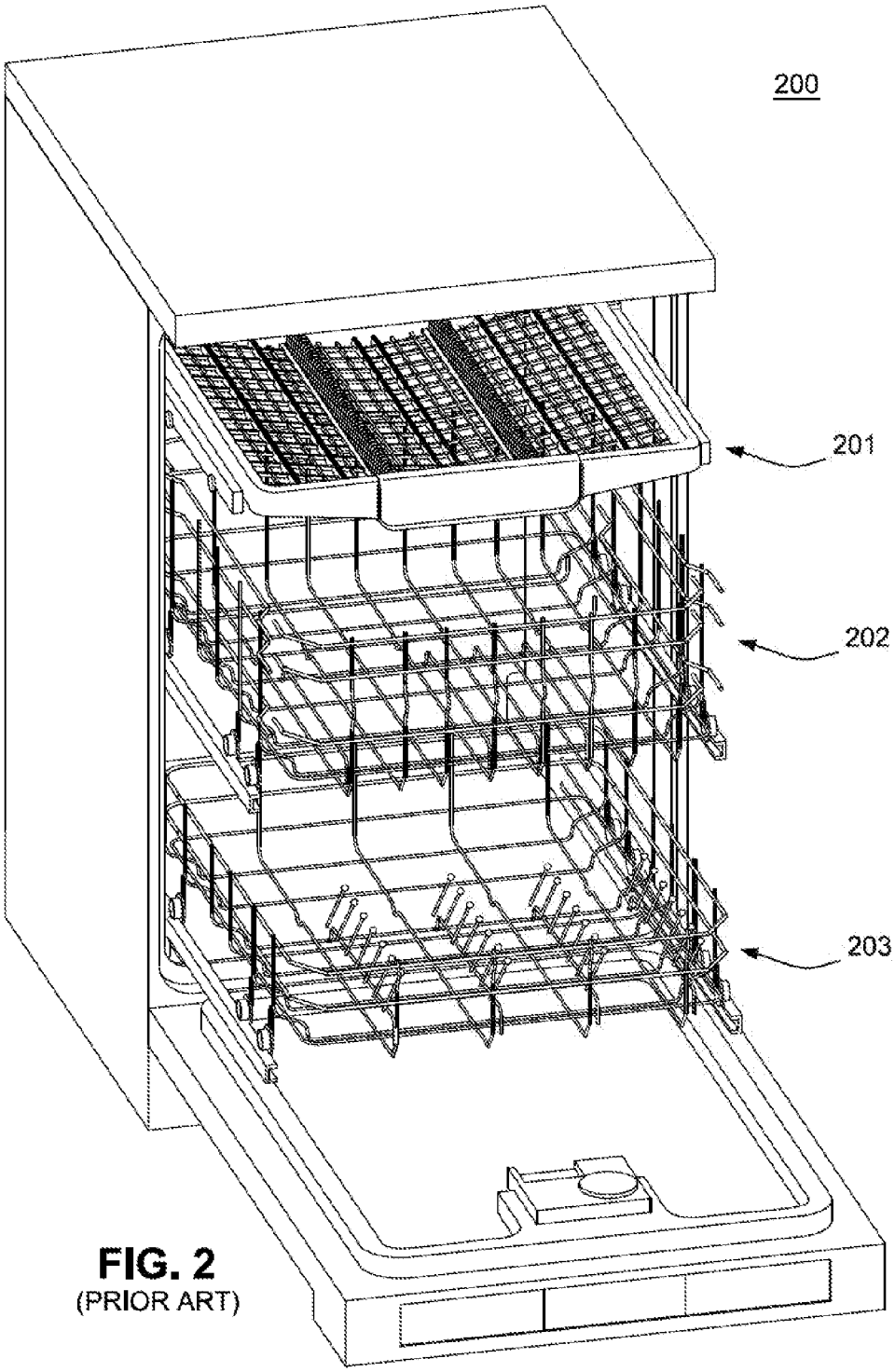
FIG. 2 (PRIOR ART)
FIG. 2 is an illustrative example of an existing dishwasher with three racks.

FIG. 2 illustrates an existing dishwasher utilizing a three rack configuration. In this example, simplified relative to FIG. 1, the dishwasher 200 comprises a first, top rack 201, a second, middle rack 202, and a third, bottom rack 203. The top rack 201 is configured to be the same or very similar in terms of width and depth to the middle rack 202 and the bottom rack 203, but with a significantly reduced height. As is clear from the example, the top rack 201 may be configured to have a height which is less than or approximately half the height of either middle rack 202 or bottom rack 203.

Figure 3A:
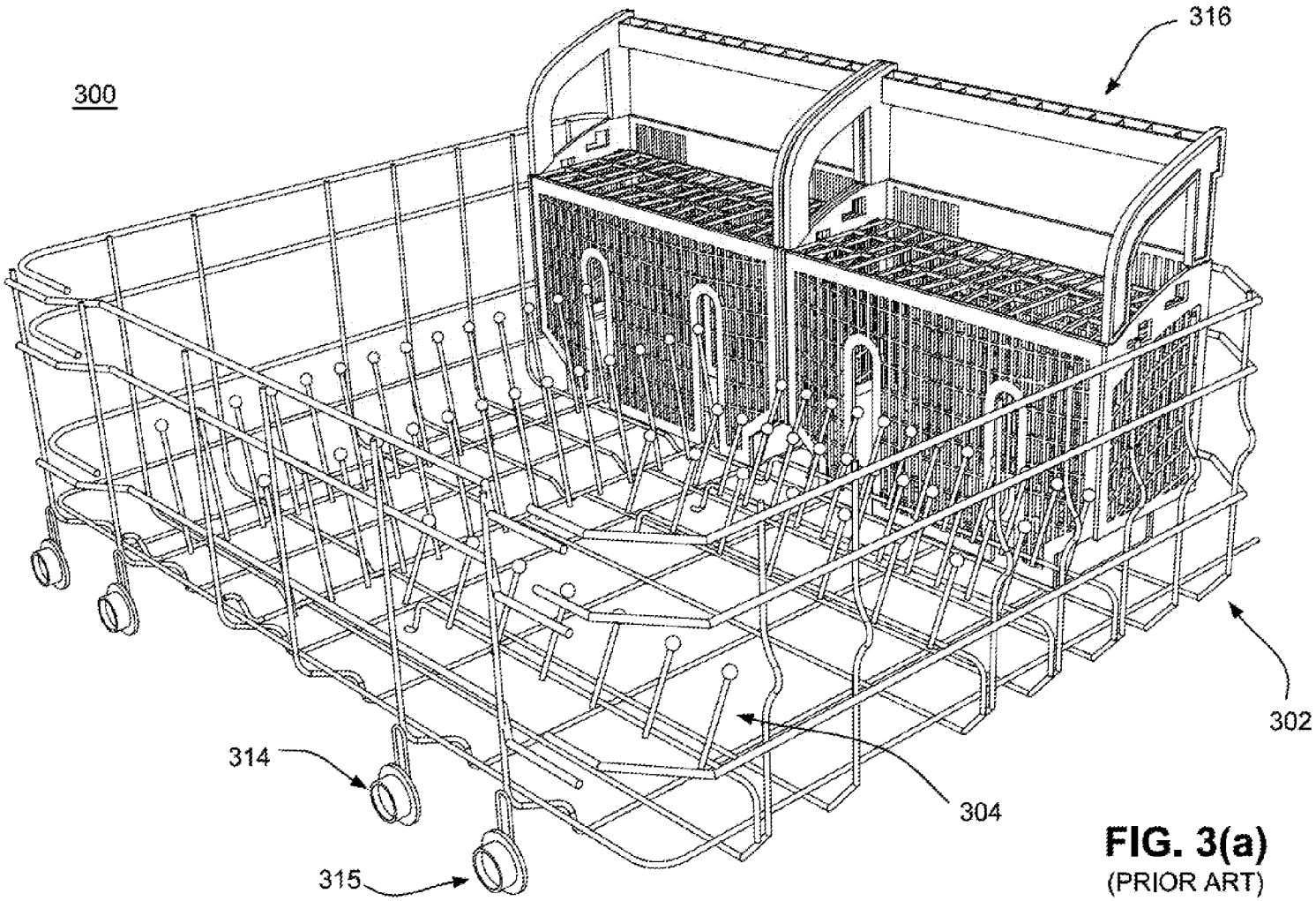
FIG. 3(a) (PRIOR ART)
FIG. 3(*a*) is an illustrative example of a standard middle or bottom rack provided in a standard dishwasher comprising three racks.
Figure 3B:
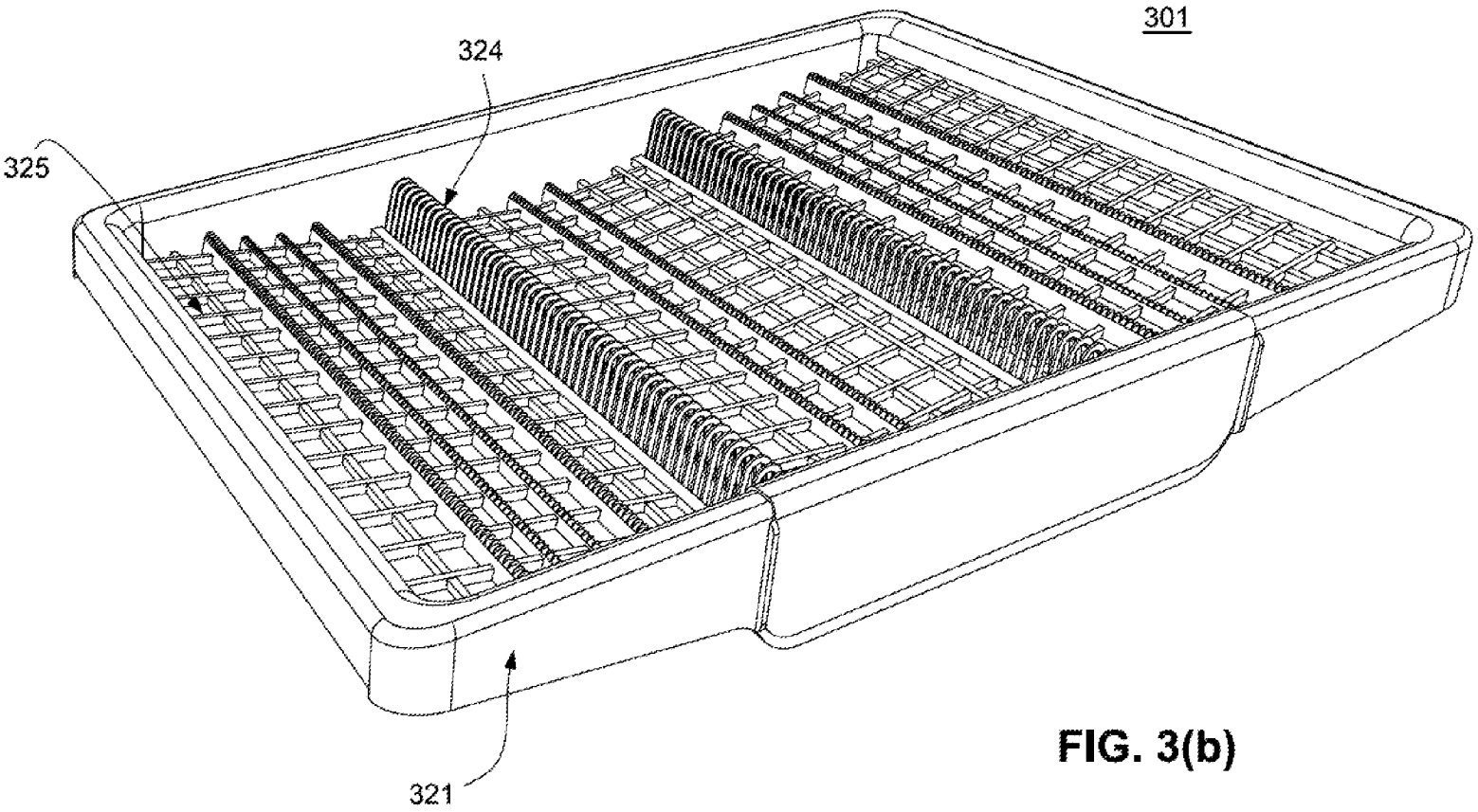

FIG. 3(*a*) shows an example of a standard rack found in some existing dishwashers. This configuration is most commonly associated with a bottom or middle rack where the dishwasher features three racks. Rack 300 includes at least rack body 302, tines 304, and compartment engagement means 315. Compartment engagement means are often a set of wheels 314 or sliders which engage guide components that allow the rack to be pulled at least partially from the compartment when the dishwasher is open and not in use. The rack body 302 may be created with a flat, substantially box-like shape, or its base may be contoured and sloped in a predetermined pattern configured to fit a combination of glassware, dishware, crockery, and utensils. Tines 304 may be arranged in a predetermined pattern as well to aid with receiving and maintaining a combination of glassware, dishware, crockery, and utensils during a washing and/or treatment cycle within the dishwasher. A rack may also comprise a utensil basket 316 specifically designed to receive utensils and keep them separate from the rest of the rack and items placed thereon. Some existing dishwashers commonly have two such racks arranged such that a top rack and a bottom rack are designed with different depths and/or patterns of tines to accommodate different items of glassware, dishware, crockery and/or utensils. Generally, existing dishwasher racks are constructed as wire frames and/or as perforated bodies configured to allow the free movement of water, detergent, and particles removed from items placed into the dishwasher for treatment and/or cleaning.

FIG. 3(*b*) shows an example of a top rack provided in a dishwasher utilizing a three rack system. The top rack 301 consists of a rack body 321, optional tines 324 (some third racks consist simply of a flat surface or basket without tines), and a bottom surface 325 through which at least water may pass. In some configurations, the bottom surface 325 is also configured to allow foodstuffs and other items washed from at least crockery, utensils, and dishes to pass through. The bottom surface 325 may be designed with a variety of patterns. The example shown in FIG. 3(*b*) utilizes a cross-hatched grid configuration.

Figure 4A:
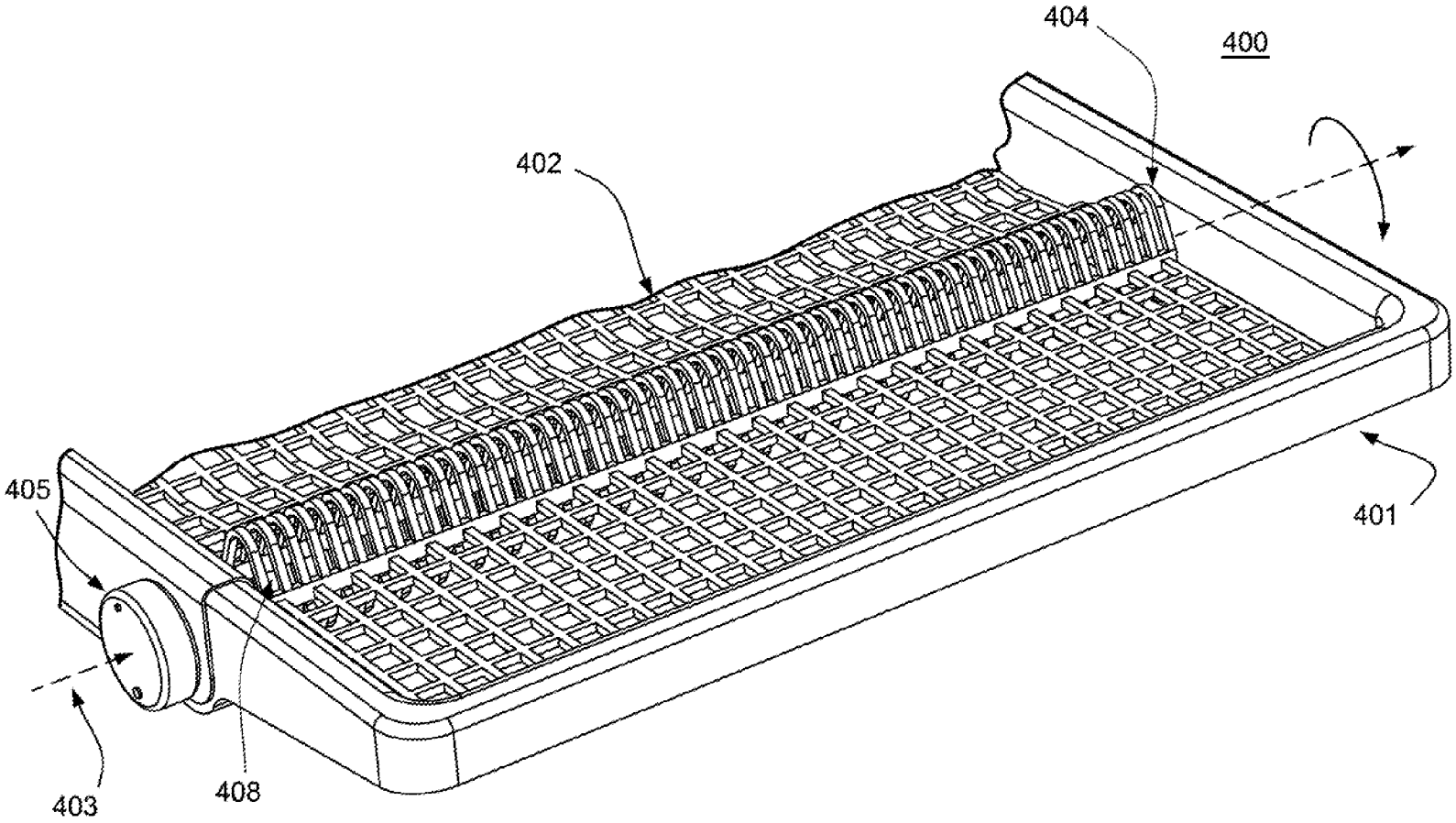
FIG. 4(*a*) is a perspective view of a rack according to a first example of the present technology in a first configuration.
Figure 4B:
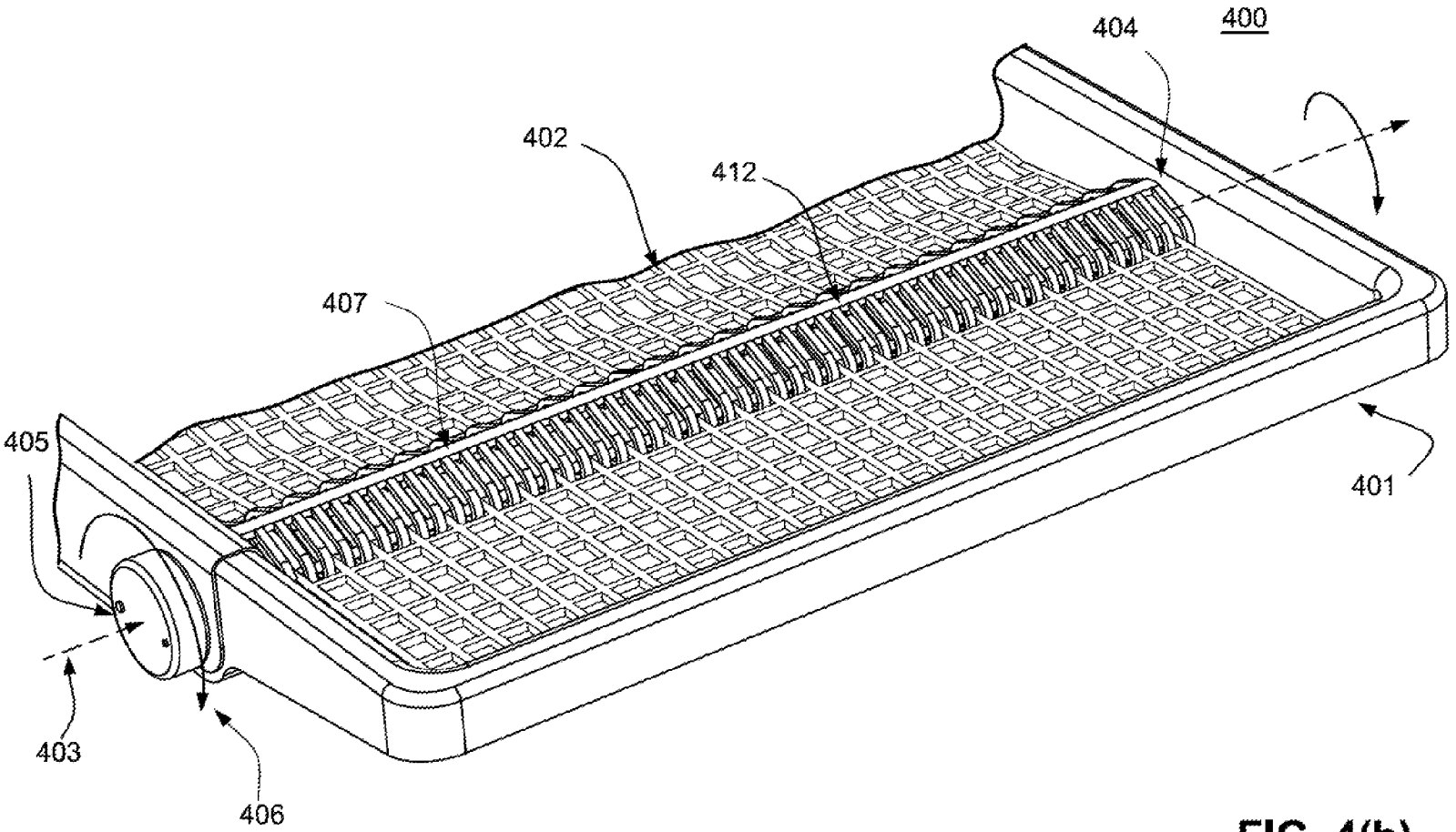
Figure 4C:
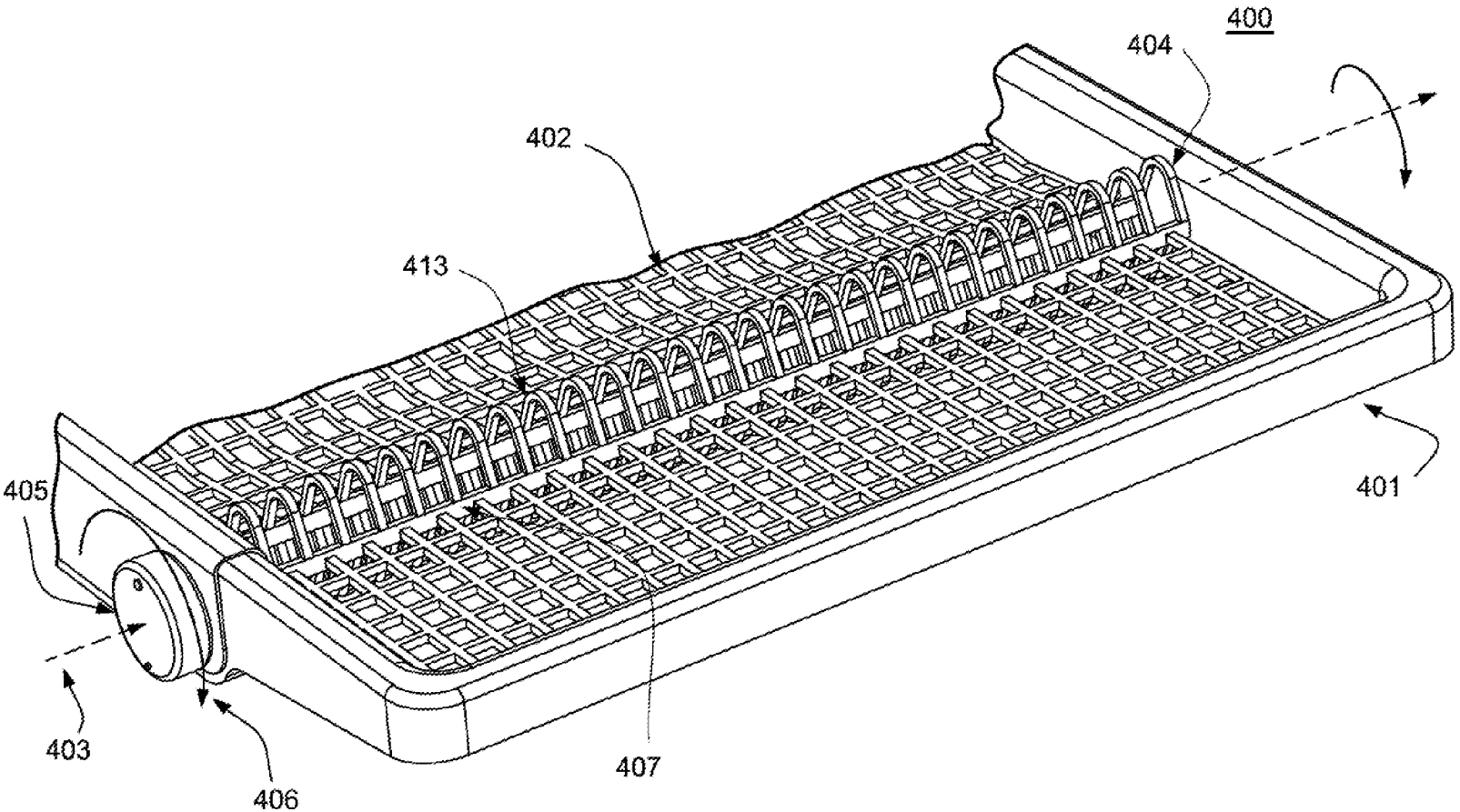

FIG. 4(*a*) illustrates a first example of the improved design of the invention. In this example, rack 400 is illustrated as a top rack being of a reduced height relative to other racks contained within the compartment of the dishwasher. In the design of such top racks, the integration of a third rack requires reduced dimensions of the rack and increased proximity to the housing of the dishwasher such that tall items such as glassware, and stemware in particular, is not able to be accommodated in a top, third rack. However, in alternate examples, the ideas and teachings of this application may be incorporated into any of the racks utilized within a dishwasher system. Rack 400 is designed as a frame 401 comprising a perforated wire frame base 402 configured to allow water, detergent, dirt particles, and other items associated with treatment and/or wash cycles to pass through the wire frame base 402. Rack 400 also comprises at least one actuator 405 which is configured to change the configuration of at least one set of tines 404 arranged across the body of the wire frame base 402. The actuator 405 is illustrated as a manual front-facing knob, but may also be configured as, e.g., a switch, a button or set of buttons, a sliding catch, or a computerized/automated system, among other options. In the illustration, the tines 404 are arranged along a single axis 403 and the actuator 405 is a knob arranged at the front of the frame 401 when viewed from the front of the dishwasher. The actuator may be positioned along a front edge of the rack or anywhere accessible to a user such that it may be actuated by the user when the rack is within or pulled out from the dishwasher.

In this particular example, the knob of actuator 405 is configured to allow a user to rotate a central tine body 408, the rotation of which allows the selection of one of a finite number of tine 404 arrangements. Thus, the actuator 405 allows a user to select from a finite number of tine configurations to select an appropriate set of tines for a particular wash cycle. In the example and configuration of FIG. 4(*a*), the actuator 405 has been turned to select tines 404 having a first setting 411 with a first height, thickness, and spacing, the tines 404 extending completely across the frame base 402. The central tine body runs the length of the rack and may be attached to the tine arrangements from within. One end of the tine body may be attached permanently or releasably to the actuator at the front end of the top rack with the other end attached permanently or releasably attached to the other end of the top rack and/or fitted into a groove which allows rotation.

FIG. 4(*b*) illustrates the first example of the improved design of the invention with the tine selection actuator 405 turned (as illustrated by arrow 406) such that the central tine body 408 has been rotated relative to FIG. 4(*a*) and a second arrangement/configuration 412 of tines 404 has been selected. In the second setting, a lateral spine 407 is exposed as the tines 404 are substantially reduced to present a minimized interruption to the wire frame base 402 compatible with the placement of plates, pans, and/or other larger items with which tines would interfere. Additional items such as silverware, knives, and large utensils may be more easily accommodated. In one example, the tines are effectively eliminated in one selectable setting. In the second example, it can also be seen that the base 402 has been designed to accommodate the tines of first setting 411 and 413 such that when the second setting 412 is selected by a user, two tines provided with first setting 411 can fit in each provided space within the base on one side of tine body 408 and one tine provided with the third setting 413 can fit into each provided space in the base 402 on the other side of tine body 408.

FIG. 4(*c*) illustrates the first example of the improved design of the invention with the tine selection actuator 405 turned (as illustrated by arrow 406) such that the central tine body rotates further and a third configuration 413 of tines 404 is selected. In this third selected state, the tines 404 and are larger in height and spaced farther apart than the first configuration found in FIG. 4(*a*). In this configuration, a user of the dishwasher would have the option of placing larger utensils or other items within the rack, separated and held in place by the tines 404. Here, larger utensils may mean utensils with wider handles or larger features. While in FIGS. 4(*a*)-4(*c*) three selectable tine configurations are selectable, in other examples, there may be more or fewer selectable settings.

Figure 5A:
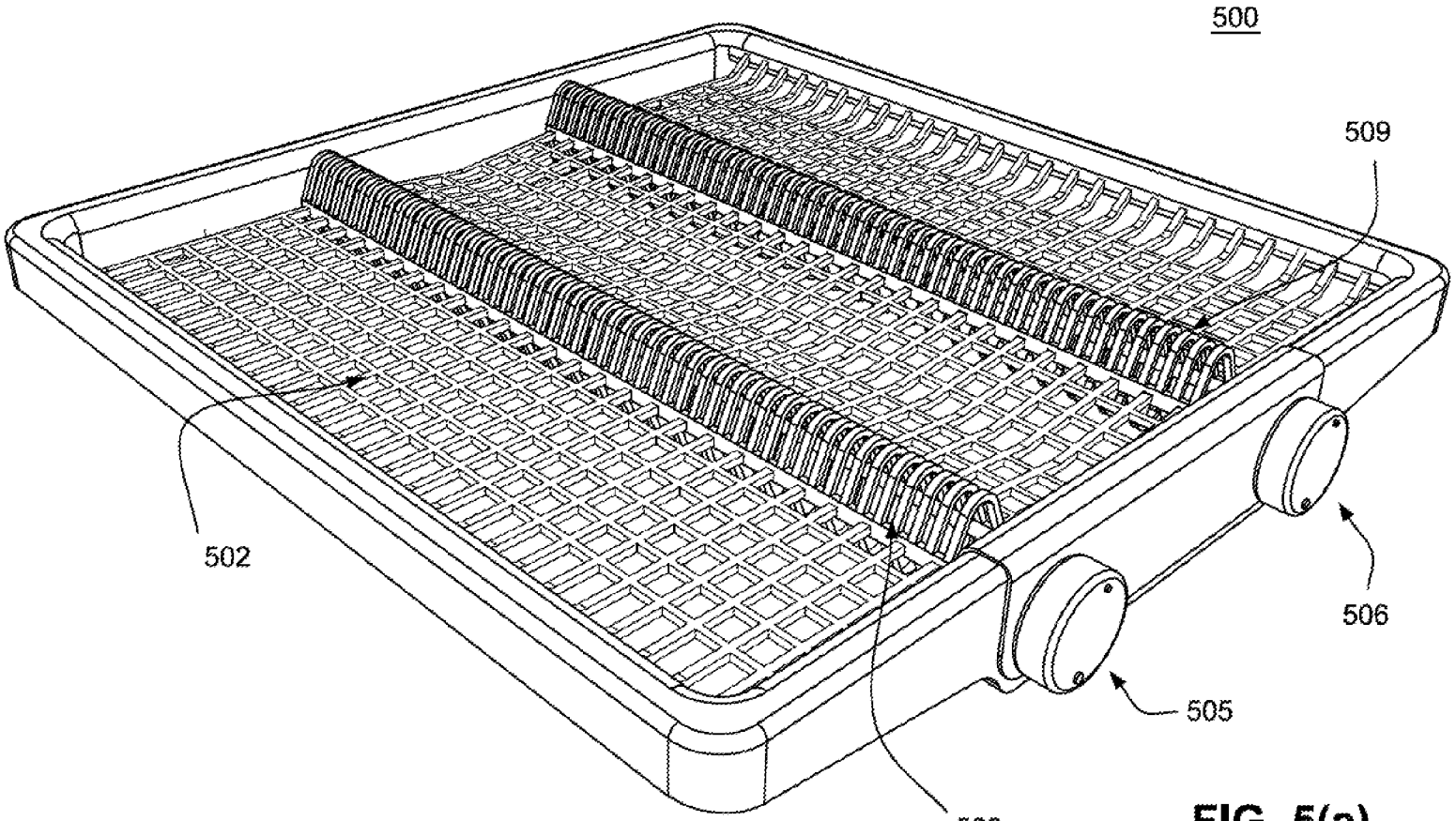
FIG. 5(*a*) is a perspective view of a rack according to a second example of the present technology.
Figure 5B:
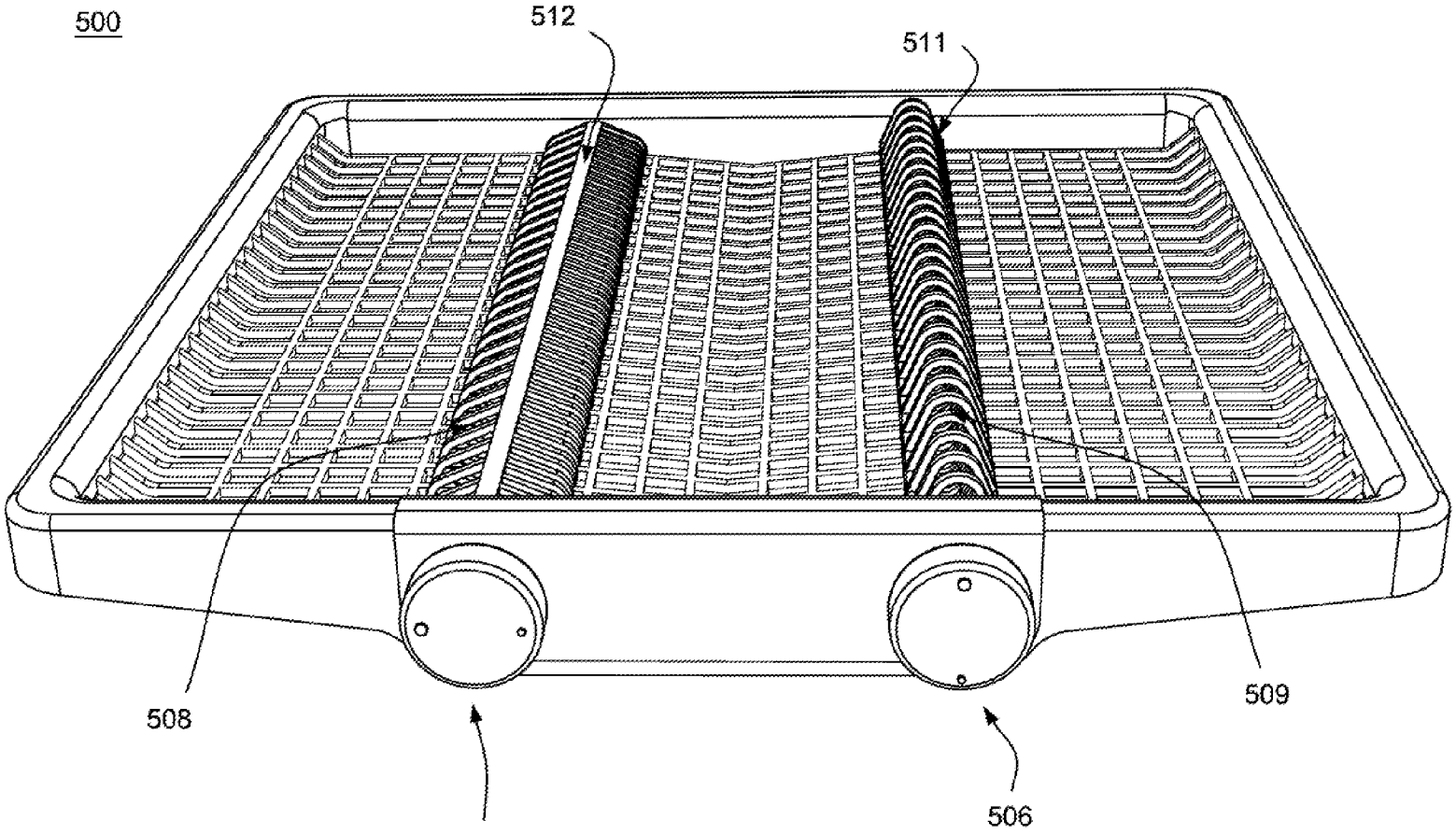

FIGS. 5(*a*)-5(*b*) illustrate a second example of the improved design of the invention. The second example utilizes the tine selection actuator of FIGS. 4(*a*)-4(*c*) and the first, second, and third configuration as selectable options for its tines, but utilizes a second central tine body 509 extending across wire frame base 502. In this illustration, first tine body 508 and second tine body 509 are oriented in parallel. FIG. 5 illustrates a first actuator 505 for selecting a tine configuration of first tine body 508 and a second actuator 506 for selecting a tine configuration of the second tine body 509. In FIG. 5(*a*), both the first actuator 505 and the second actuator 506 have been oriented to provide the same tine configuration. In FIG. 5(*b*), the first actuator 505 and the second actuator 506 have been oriented to provide two different tine configurations. The actuators may be configured to be operated independently or cooperatively.

FIGS. 4(*a*)-5(*b*) illustrate the first and second examples, which are not limited to only having three configurations available for selection by the actuator. The central tine body may offer any number of predetermined configurations of tines to be selected by the actuator. Additionally, there may be one, two, or more tine bodies utilized to provide a set of predetermined tine configurations which may be arranged in parallel, equally spaced across the wire frame base, or they may be oriented at angles to each other at varying distances.

In an alternative configuration the actuator is configured to allow dynamic selection of tines configured to project from a central tine body. In such an alternative, actuating the actuator, instead of simply rotating a central body to choose between a discrete number of preselected tine arrangements, causes the tines to project more or less from the central tine body, rather than simply rotating the central tine body from a first predetermined configuration to an alternative second, third, etc., configuration. Such a dynamic system could be accomplished by a coiling mechanism which allows a material comprising the tines to be released or stored, depending on if a user wishes to make the tines larger or smaller. Instead, or with an additional actuator, a user may be able to actuate the actuator such that the tines move farther away from each other or closer together. Such a feature may be accomplished by utilizing a similar coiling system, but instead of the individual tines each having material which causes the tines to expand or contract, such material goes the length of the tine body and may be extended or contracted from the front or rear of the rack body to cause the tines to shift axially as desired.

While the present technology has been described in connection with several practical examples, it is to be understood that the technology is not to be limited to the disclosed examples, but on the contrary, is intended to cover various modifications and equivalent arrangements included within the spirit and scope of the technology.

What is claimed:

1. A domestic appliance comprising:

a housing;

a compartment within the housing;

an opening arranged in the compartment configured to allow at least one of the insertion or removal of items to be at least one of cleaned or treated into the housing;

a door configured to close the opening and create a sealed compartment during use; and a first component arranged within the compartment configured to receive items to be at least one of washed or treated during use of the domestic appliance, the first component includes at least one support;

wherein the first component includes an actuator configured to alter at least one of a shape or position of the support, wherein the support comprises a plurality of engagement elements, wherein the plurality of engagement elements comprises at least a first configuration in which the plurality of engagement elements projects from the first component, a second configuration in which the plurality of engagement elements is reduced in height with respect to the first component, and a third configuration in which at least a gap spacing between adjacent ones of the plurality of engagement elements is different as compared to the first configuration, and wherein the actuator is configured to rotate the support, such that any one of the first configuration, the second configuration, or the third configuration can be selected by rotating the actuator.

2. The domestic appliance according to claim 1, wherein the appliance is a dishwasher.

3. The domestic appliance according to claim 2, wherein the dishwasher comprises a plurality of racks.

4. The domestic appliance according to claim 3, wherein the first component is a top rack of said plurality of racks.

5. The domestic appliance according to claim 4, wherein the actuator is configured to rotate a central body of the support which runs the length of the top rack.

6. The domestic appliance according to claim 5, wherein the plurality of engagement elements is attached to the central body along a length of the central body.

7. The domestic appliance according to claim 1, wherein the plurality of engagement elements comprises at least one set of rotatable tines.

8. The domestic appliance according to claim 7, wherein the actuator is configured to rotate the at least one set of rotatable tines from at least the first configuration to the second configuration.

9. The domestic appliance according to claim 8, wherein the actuator is configured to rotate the at least one set of rotatable tines to the second configuration which comprises a null position such that no tines project from the first component.

10. The dishwasher according to claim 1, wherein the actuator is a rotatable knob.

11. A dishwasher comprising:

a housing;

a compartment within the housing;

an opening arranged in the compartment configured to allow at least one of the insertion or removal of at least one of dishware or crockery to be at least one of cleaned or treated into/from the housing;

a door configured to close the opening and create a sealed compartment during use;

at least a first rack, the first rack being slidably installed within the compartment and configured to be movable from a retracted position where the first rack is substantially within the compartment to an extended position where the first rack is substantially projecting out of the compartment; and an actuator configured to adjust a configuration of the first rack to accommodate a variety of different sized and shaped items of at least one of dishware or crockery, wherein at least the first rack comprises at least one set of rotatable tines, wherein the at least one set of rotatable tines comprises at least a first line configuration in which the at least one set of rotatable tines projects from the first rack, a second tine configuration in which the at least one set of rotatable tines is reduced in height with respect to the first rack, and a third tine configuration in which at least a gap spacing between adjacent ones of the at least one set of rotatable tines is different as compared to the first tine configuration, and wherein the actuator is configured to rotate the at least one set of rotatable tines, such that any one of the first tine configuration, the second tine configuration, or the third line configuration can be selected by rotating the actuator.

12. The dishwasher according to claim 11, wherein the actuator is a rotatable knob.

13. The dishwasher according to claim 11, wherein the dishwasher comprises a plurality of racks and the first rack is a top rack.

14. The dishwasher according to claim 13, wherein the top rack is configured to be of a smaller depth than any other of the plurality of racks.

15. The dishwasher according to claim 14, wherein at least the top rack comprises the at least one set of rotatable tines.

16. The dishwasher according to claim 11, wherein the second tine configuration comprises a null position such that no tines project from the first rack.

17. The dishwasher according to claim 11, wherein the first rack comprises at least two sets of rotatable tines configured to be individually controllable by independent actuators.

* * * * *